US006274238B1

(12) United States Patent
DeLucia

(10) Patent No.: US 6,274,238 B1
(45) Date of Patent: Aug. 14, 2001

(54) STRENGTH IMPROVED SINGLE POLYMER CONJUGATE FIBER WEBS

(75) Inventor: Mary Lou DeLucia, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/375,196

(22) Filed: Jan. 18, 1995

Related U.S. Application Data

(63) Continuation of application No. 08/226,611, filed on Apr. 12, 1994.

(51) Int. Cl.[7] ..... D02G 3/00

(52) U.S. Cl. ..... 428/373; 428/351; 428/246; 428/354; 428/365

(58) Field of Search ..... 428/351, 296, 428/374, 373, 359, 365

(56) References Cited

U.S. PATENT DOCUMENTS

| | | | | |
|---|---|---|---|---|
| 3,200,440 | | 8/1965 | Bryan et al. | 18/8 |
| 3,399,259 | | 8/1968 | Brayford | 264/168 |
| 3,423,266 | | 1/1969 | Davies et al. | 156/167 |
| 3,601,846 | | 8/1971 | Hudnall | 18/8 SC |
| 3,692,618 | | 9/1972 | Dorschner et al. | 161/72 |
| 3,730,662 | | 5/1973 | Nunning | 425/131 |
| 3,780,149 | * | 12/1973 | Keuchel et al. | 264/168 |
| 3,802,817 | | 4/1974 | Matsuki et al. | 425/66 |
| 3,855,045 | | 12/1974 | Brock | 161/146 |
| 3,855,046 | | 12/1974 | Hansen et al. | 161/150 |
| 3,938,813 | * | 2/1976 | Forch | 277/152 |
| 4,163,819 | * | 8/1979 | Yung et al. | 428/198 |
| 4,211,816 | * | 7/1980 | Booker et al. | 428/296 |
| 4,234,655 | * | 11/1980 | Kuuimune et al. | 428/374 |
| 4,269,888 | | 5/1981 | Ejima et al. | 428/296 |
| 4,285,748 | * | 8/1981 | Booker et al. | 428/288 |
| 4,323,626 | * | 4/1982 | Kunimune et al. | 428/374 |
| 4,340,563 | | 7/1982 | Appel et al. | 264/518 |
| 4,551,378 | * | 11/1985 | Carey, Jr. | 428/198 |
| 4,758,293 | | 7/1988 | Samida | 156/73.1 |
| 4,840,847 | * | 6/1989 | Ohmae et al. | 428/373 |
| 5,082,720 | | 1/1992 | Hayes | 428/224 |
| 5,318,552 | * | 6/1994 | Shiba et al. | 604/366 |

FOREIGN PATENT DOCUMENTS

| | | |
|---|---|---|
| 0445536A2 | 9/1991 | (EP) . |
| 1087823 | 10/1967 | (GB) . |
| 1116823 | 6/1968 | (GB) . |
| 0552013A2 | 7/1993 | (WO) . |

OTHER PUBLICATIONS

J.L. Thomason and A.A. Van Rooyen: "Transcrystallized Interphase in Thermoplastic Composites": Part I, Journal of Materials Science 27 (1992) pp. 889–896.

J.L. Thomason and A.A. Van Rooyen: "Transcrystallized Interphase in Thermoplastic Composites": Part II, Journal of Materials Science 27 (1992) pp. 897–907.

Michael S. Chuu and Boh C. Tsai: "Shear–Induced Crystallization of Polyolefins": Polymeric Materials Science and Engineering, V.61 Fall 1989, pp. 166–170.

* cited by examiner

*Primary Examiner*—Merrick Dixon
(74) *Attorney, Agent, or Firm*—Ralph H. Dean, Jr.

(57) ABSTRACT

The present invention provides a high strength autogenously bonded nonwoven fabric containing single polymer conjugate fibers which have at least two substantially the same component compositions, wherein the component compositions of the fibers contain one thermoplastic polymer selected from the group consisting of semicrystalline thermoplastic polymers, crystalline thermoplastic polymers and blends thereof. The component compositions are processed with substantially identical processing conditions to form the fibers and have substantially the same melt flow rate as measured in accordance with the ASTM 1238-65T testing procedure.

16 Claims, 1 Drawing Sheet

STRENGTH IMPROVED SINGLE POLYMER CONJUGATE FIBER WEBS

CROSS-REFERENCE TO RELATED APPLICATION

This application is a continuation of application Ser. No. 08/226,611, filed Apr. 12, 1994.

The present invention is directed to a nonwoven fiber web. More particularly, the present invention is directed to a bonded nonwoven fiber web having improved physical strength.

Nonwoven fabrics produced from thermoplastics have been widely used especially for disposable articles. However, nonwoven fabrics do not tend to exhibit the physical strength of woven fabrics. There have been many attempts to provide nonwoven fabrics having improved physical strength properties. For example, European Patent Application 0 552 013 provides a strength-improved polypropylene nonwoven web produced from a blend of at least two polypropylene resins having different melt flow rates. European Patent Application 0 445 536 discloses a high strength melt spun polyolefin fibers that are selectively subjected to an oxidative degradation process to contain distinct cross sections having different degrees of oxidative degradation.

However, the prior art processes of producing monocomponent fibers having improved strength require a careful selection of different polymers or a complicated production process. Consequently, it would be highly desirable to provide a strength-improved fiber web that can be produced from one polymer without the need for a complicated manufacturing process.

SUMMARY OF THE INVENTION

The present invention provides a high strength autogenously bonded nonwoven fabric containing single polymer conjugate fibers which have at least two substantially the same component compositions. The component compositions of the fibers have one thermoplastic polymer selected from the group consisting of semicrystalline thermoplastic polymers, crystalline thermoplastic polymers and blends thereof, wherein the component compositions are processed with substantially identical processing conditions to form the fibers. In addition, the component compositions of the fibers have substantially the same melt flow rate as measured in accordance with the ASTM 1238-65T testing procedure.

The present invention further provides a process for producing a high strength bonded nonwoven fabric comprising the steps of supplying at least two melt-extrudate streams of a thermoplastic polymer to a sheath-core conjugate fiber forming apparatus to form conjugate fibers, depositing the conjugate fibers onto a forming surface to form a nonwoven fiber web, and thermally bonding the nonwoven fiber web, wherein the melt-extrudates have substantially the same melt flow rate as measured in accordance with the ASTM 1238-65T testing procedure and the thermoplastic polymer is selected from the group consisting of semicrystalline polymers, crystalline polymers and blends thereof.

The bonded nonwoven fabric of the present invention fabricated from single polymer sheath-core conjugate fibers of a semicrystalline or crystalline polymer provides improved physical properties over bonded monocomponent fiber fabric of the same the same polymer.

DETAILED DESCRIPTION OF THE INVENTION

Figure 1:
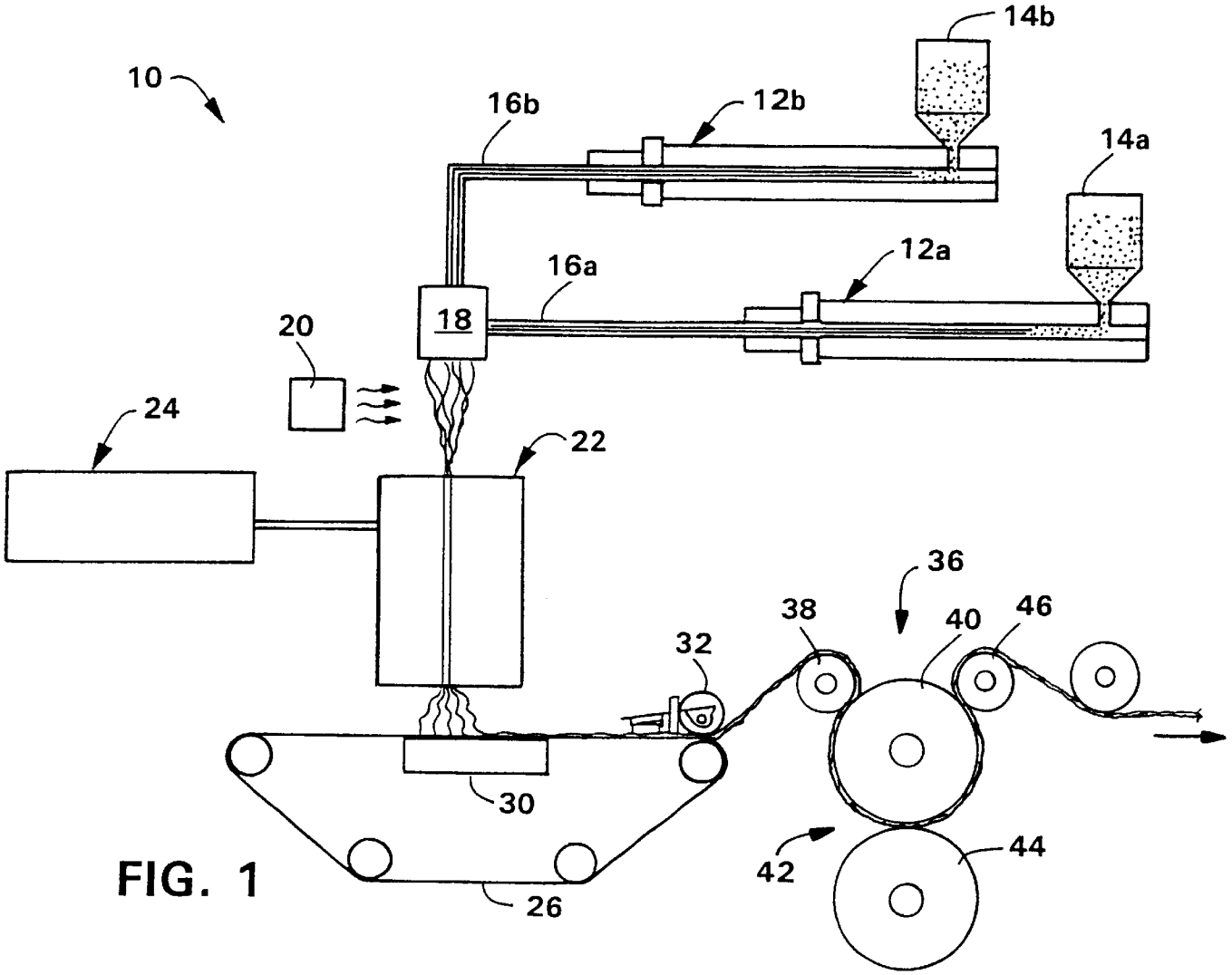
FIG. 1 illustrates a suitable process for producing the nonwoven conjugate fiber webs of the present invention.

The present invention provides a strength-improved autogenously bonded nonwoven fabric, which is fabricated from conjugate fibers of a semicrystalline or crystalline thermoplastic polymer. The present nonwoven fabrics are produced from single polymer conjugate spunbond fibers or single polymer conjugate staple fibers having a sheath-core configuration, such as a concentric or an eccentric sheath-core configuration. Suitable conjugate fibers contain at least two component polymer compositions. For example, suitable bicomponent conjugate fibers have a first polymeric component and a second polymeric component that are arranged in substantially distinct core and sheath zones, respectively, which are extended continuously along the substantially entire length of each fiber. The strength-improved nonwoven fabric of the present invention is suitable for making nonwoven fabric articles including disposable articles, e.g., towels, wipes, examination gowns, surgical drapes, diapers, sanitary napkins, incontinence products, car-covers and the like.

The term "single polymer conjugate fibers" refers to melt-extruded fibers containing at least first and second components of one polymeric composition or substantially identical polymeric compositions. The term "substantially identical polymeric compositions" as used herein indicates polymer compositions that contain the same thermoplastic polymer and different amounts and types of conventional polymer additives that do not significantly alter the chemical and physical properties of the polymer, e.g., pigments, colorants, lubricants, fillers and the like. The term "spunbond conjugate fiber web" refers to a nonwoven fiber web of small diameter fibers that are formed by simultaneously extruding at least two molten component polymeric compositions as a plurality of unitary multicomponent filaments or fibers from a plurality of capillaries of a spinneret. The extruded filaments are partially cooled and then rapidly drawn by an eductive or other well-known drawing mechanism. The drawn filaments are deposited or laid onto a forming surface in a random, isotropic manner to form a loosely entangled nonwoven fiber web, and then the laid fiber web is subjected to a bonding process to impart physical integrity and dimensional stability. The production of spunbond fiber webs is disclosed, for example, in U.S. Pat. Nos. 4,340,563 to Appel et al. and 3,692,618 to Dorschner et al., and the conjugate spinneret assemblies suitable for the present invention are disclosed, for example, in U.S. Pat. Nos. 3,200,440 to Bryan et al. and 3,730,662 to Nunning. Typically, spunbond fibers have an average diameter in excess of 10 $\mu$m and up to about 55 $\mu$m or higher, although finer spunbond fibers can be produced. Spunbond fibers tend to have a higher degree of molecular orientation and thus have higher physical strength than other melt-processed fibers. The term "carded staple fiber web" refers to a nonwoven web that is formed from staple fibers. Staple fibers are produced with a conventional staple fiber forming process, which typically is similar to the spunbond fiber forming process, and then cut to a staple length. The staple fibers are subsequently carded to form a nonwoven fiber web and then bonded to form a nonwoven fabric having physical integrity and strength.

Suitable bonding processes for the present nonwoven fiber webs include calender bonding and ultrasonic bonding processes which thermally melt-fuse the fibers of the webs. Although the nonwoven webs may contain supplementary adhesive components, e.g., particles or fibers of a hot-melt adhesive or solvent-based adhesive, the present nonwoven webs desirably are autogenously bonded. Generally described, a calender bonding process bonds a nonwoven fiber web by passing the web through the nip of an abuttingly-placed pair of counterrotating heated rolls which applies a combination of heat and pressure to autogeneously melt-fuse the fibers of the webs. One or both of the heated rolls may be smooth or contain patterns of intermittently raised bond points to provide different bond patterns. In accordance with the present invention, it is highly desirable to have one or both of the heated rolls contain a regularly-repeating pattern of raised bond points so that a nonwoven web bonded with the heated rolls contains intermittent, regularly-repeating bond points throughout its surface. Generally, a nonwoven fabric bonded with a patterned heated roll provides desirable tactile properties including soft texture and good flexibility, while a nonwoven fabric bonded with a smooth heated roll provides improved physical strength and rigidity. Bonding processes suitable for the present invention are well known in the art and, for example, disclosed in U.S. Pat. Nos. 3,855,045 to Brock and 3,855,046 to Hansen et al. Generally described, an ultrasonic bonding process suitable for the present invention applies high speed ultrasonic vibrations to generate localized heat to melt-fuse the fibers of a thermoplastic nonwoven web, providing bond points. A suitable ultrasonic bonding process, for example, is disclosed in U.S. Pat. No. 4,758,293 to Samida.

In accordance with the present invention, the single polymer conjugate fibers are produced from polymeric component compositions of one thermoplastic polymer, and the component polymer compositions of the conjugate fibers are processed with an identical processing condition or substantially identical processing conditions. Alternatively stated, the polymeric components are not only the same polymer composition but also are exposed to the same or substantially the same processing conditions and thermal histories. Correspondingly, the polymeric component compositions of the conjugate fibers have identical or substantially identical chemical and physical properties. For example, the difference in the melt flow rates of the processed component compositions as measured in accordance with the ASTM 1238-65T testing procedure is equal to or less than about 10 g/10 min, desirably equal to or less than about 5 g/10 min, more desirably equal to or less than about 1 g/10 min and most desirably equal to or less than about 0.1 g/10 min.

It has surprisingly been found that the present thermally bonded nonwoven fabric produced from the single polymer conjugate fibers provides highly improved physical strength over nonwoven fabrics of monocomponent fibers of the same polymeric composition. Although it is not wished to be bound by any theory, it is believed that the improved strength of the present fabric is derived from the improved strength of the single polymer conjugate fibers and of the bond points, and the strength improvement is believed to be derived from the presence of an interphase between the sheath and core polymer components of the conjugate fibers. It is believed that when the sheath and core components are extruded through a sheath-core die in a conventional spinneret assembly to form conjugate fibers, there is no significant driving force to intermix the two extruded sections, i.e., sheath section and core section, of the fibers and the polymer components of the two sections tend to flow in a laminar fashion, forming and preserving the interphase. In addition, it is believed that the presence of the interphase promotes shear stress-induced nucleation and crystallization of the polymer of the fibers, especially at the interphase, improving the strength of the fabric.

Suitable polymers for the single polymer conjugate fibers are semicrystalline and crystalline thermoplastic polymers including polyolefins, polyesters, polyamides, acetals, acrylic polymers, polyvinyl chloride, vinyl acetate-based polymer and the like, as well as blends thereof. Polyolefins suitable for the present invention include polyethylenes, e.g., high density polyethylene, medium density polyethylene, low density polyethylene and linear low density polyethylene; polypropylenes, e.g., isotactic polypropylene and syndiotactic polypropylene; polybutylenes, e.g., poly(1-butene) and poly(2-butene); polypentenes, e.g., poly(2-pentene), and poly(4-methyl-1-pentene); and copolymers thereof, e.g., ethylene-propylene copolymer; as well as blends thereof. Of these, more desirable polyolefins are polypropylenes and polyethylenes, more particularly, isotactic polypropylene, high density polyethylene, and linear low density polyethylene. Suitable vinyl acetate-based polymers include polyvinyl acetate; ethylene-vinyl acetate; saponified polyvinyl acetate, i.e., polyvinyl alcohol; ethylene-vinyl alcohol and blends thereof. Suitable polyamides include nylon 6, nylon 6/6, nylon 10, nylon 4/6, nylon 10/10, nylon 12, hydrophilic polyamide copolymers such as caprolactam and alkylene oxide, e.g., ethylene oxide, copolymers and hexamethylene adipamide and alkylene oxide copolymers, and blends thereof. Suitable polyesters include polyethylene terephthalate, polybutylene terephthalate, and blends thereof. Acrylic polymers suitable for the present invention include polymethyl methacrylate, ethylene acrylic acid, ethylene methacrylic acid, and the like as well as blends thereof. Additionally suitable polymers for the present invention are crystalline or semicrystalline block copolymers, crystallizable random copolymers and blends thereof, as well as blends of a crystalline or semicrystalline polymer and a minor amount of an amorphous polymer. In addition, the fiber composition may further contain minor amounts of compatibilizing agents, colorants, pigments, abrasion resistance enhancing agents, crimp inducing agents, nucleating agents, fillers and the like.

Although any sheath-core conjugate fiber web forming process known in the art can be used to produce the single polymer conjugate fiber web of the present invention, FIG. 1 illustrates an exemplary and highly suitable process 10 for the present invention. The process 10 illustrates a process for producing a nonwoven fabric of single polymer conjugate spunbond fibers. A pair of extruders 12*a* and 12*b* separately extrude one polymeric composition, which composition is fed into a first hopper 14*a* and a second hopper 14*b*, to simultaneously supply molten polymeric compositions to a spinneret 18 through conduits 16*a* and 16*b*. Alternatively, one large extruder can be utilized to supply a molten polymeric composition to the conduits 16*a* and 16*b*. Suitable spinnerets for extruding conjugate fibers are well known in the art. Briefly, the spinneret 18 has a housing which contains a spin pack, and the spin pack contains a plurality of plates and dies. The plates have a pattern of openings arranged to create flow paths for directing the two polymers to the dies that have one or more rows of openings, which are designed in accordance with the desired configuration of the resulting conjugate fibers.

A curtain of fibers is produced from the rows of the die openings and is partially quenched by a quench air blower 20 before being fed into a fiber draw unit, or an aspirator, 22. The quenching process not only partially quenches the fibers but also develops a latent helical crimp in the fibers. Suitable fiber draw units or aspirators for use in melt spinning polymers are well known in the art, and particularly suitable fiber draw units for the present invention include linear fiber aspirators of the type disclosed in U.S. Pat. No. 3,802,817 to Matsuki et al. and eductive guns of the type disclosed in U.S. Pat. Nos. 3,692,618 to Dorschner et al. and 3,423,266 to Davis et al. Briefly, the fiber draw unit 22 includes an elongate vertical passage through which the filaments are drawn by aspirating air entering from the side of the passage from a compressed air source 24. The process line 10 further includes an endless foraminous forming surface 26 which is positioned below the fiber draw unit 22. The continuous fibers from the outlet of the draw unit are deposited onto the forming surface 26 in a random fashion to produce a continuous web of uniform density and thickness. The fiber depositing process can be assisted by a vacuum unit 30 placed below the forming surface 26. Optionally, the resulting web can be subjected to a light compacting pressure with a roller 32 to consolidate the web to impart additional physical integrity to the web before being subjected to a bonding process.

The nonwoven web is passed through, for example, a heated roll bonder 36. The web is brought to idler roll 38 and allowed to contact with the smooth surface of a heated roll 40 to heat the web. Thereafter, the heated web is passed through the pressure nip 42 formed by the smooth heated roll 40 and a second heated roll 44 which contains a plurality of raised points on its surface. The combination of the nip pressure and the heat from the heated rolls autogenously melt-fuse the fibers of the web at the raised points of the second heated roll 44 when the web passes through the nip 42. The bonded web is passed through a tensioning idler roll 46 and allowed to be cooled.

The temperature of the heated rolls 40 and 44 and the pressure of the nip 42 are selected so as to effect bonding without undesirable accompanying side effects such as excessive web shrinkage or fiber degradation. While particularly appropriate roll temperatures and nip pressures are generally influenced to an extent by such parameters as web speed, web basis weight, polymer properties and the like, the roll temperature is desirably lower than the melting temperature of the web fibers and the nip pressure on the raised points of the heated roll can be between about 3,000 to about 180,000 psi.

The strength-improved single polymer conjugate fiber webs are highly suitable for making nonwoven fabric articles including disposable articles, e.g., towels, wipes, examination gowns, surgical draperies, diapers, sanitary napkins, incontinence products, car-covers and the like. In addition, the single polymer conjugate fiber web, which provides improved strength properties over monocomponent fiber webs of the same component polymer, can be used as a structural layer for various laminate structures. The conjugate fiber web can be laminated to one or more layers of various films, e.g., polyolefin films, polyamide films and polyester films, and/or other nonwoven fiber webs, e.g., spunbond webs, meltblown webs, wet-laid fiber webs and hydroentangled fiber webs. An example of highly suitable laminate structures that can be produce with the present conjugate fiber web is disclosed in U.S. Pat. No. 4,041,203 to Brock et al., which is herein incorporated by reference.

The present invention is further described below with reference to the following examples, which are in no way intended to limit the scope of the invention.

EXAMPLES

Example 1 (Ex1)

A point bonded nonwoven fabric having about 1 ounce per square yard (osy) weight was prepared from polypropylene-sheath/polypropylene-core conjugate spunbond fibers using the production process illustrated in FIG. 1. The conjugate fibers contained 50:50 weight ratio of sheath and core components. Polypropylene, grade PD3445 from Exxon which contains a heat-stabilizer, which is believed to be 0.1 wt % Irganox 1076 heat stabilizer, was blended and extruded in a conventional extruder to contain 1 wt % of a UV stabilizer, Chimassorb 944 which is available from Ciba-Geigy, and 0.36 wt % of a beige colorant, SCC 5181 which is available from Standridge Color Corporation, Ga., based on the total weight of the composition. The polypropylene blend composition was fed into a first extruder, which supplied the core component. The first extruder was a 3.5 inch Egan single screw extruder having a 32:1 L:D ratio and five zones. Zones 1–5 were kept at 330° F., 390° F., 430° F., 430° F. and 430° F., respectively. The same polypropylene mixture was fed into a second extruder, which supplied the sheath component. The second extruder was a 2 inch Davis Standard single screw extruder having a 24:1 L:D ratio and three zones. Zones 1–3 were kept at 340° F., 390° F. and 431° F., respectively. The extruded polymer components were spun into round sheath-core conjugate fibers using a bicomponent spinning die, which had a 0.6 mm spinhole diameter and a 4:1 L/D ratio. The melt temperatures of the polymers fed into the spinning die were kept at 428° F., and the spinhole throughput rate was 0.7 gram/hole/minute. The conjugate fibers exiting the spinning die were quenched by a flow of air having a flow rate of 45 SCFM/inch spinneret width and a temperature of 53° F. The quenching air was applied about 5 inches below the spinneret, and the quenched fibers were drawn in an aspirating unit of the type which is described in U.S. Pat. No. 3,802,817 to Matsuki et al. The quenched fibers were drawn with ambient air in the aspirating unit to attain 2.9 denier fibers. Then, the drawn substantially crimp-free fibers were deposited onto a foraminous forming surface with the assist of a vacuum flow to form an unbonded fiber web.

The unbonded fiber web was bonded by passing the web through a patterned, heated roll and a smooth anvil roll that were heated to provide a surface temperature of about 280° F. The patterned roll had a bond point density of 310 regularly-spaced points per square inch, and the total surface area of the raised points covered about 15% of the roll surface. The two bonding rolls provided a nip pressure of about 87 pound per linear inch. The resulting bonded web was tested for its peak load tensile strength, which is the maximum load or force required to break the test specimen, and peak energy, which is the total energy required to break the test specimen, in accordance with Federal Standard Methods 191A, Method 5100. The strength results are shown in Table 1.

Control 1 (C1)

Polypropylene monocomponent spunbond fiber web was produced in accordance with the procedure outlined in Example 1, except the spinning die was replaced with a monocomponent die of the same dimensions and the polymer composition was supplied through the first extruder only. The extruder temperature profile was 339° F., 389° F., 431° F., 430° F. and 430° F. for zones 1–5, respectively. The monocomponent spunbond fibers had an average of 2.8 denier. The strength results are shown in Table 1.

Example 2 (Ex2)

Example 1 was repeated, except the first extruder zones 1–5 were kept at 340° F., 390° F., 429° F., 430° F. and 430°

F., respectively; the second extruder zones 1–3 were kept at 340° F., 379° F. and 430° F., respectively; and the quenching air was supplied at 58° F. The spunbond fibers had an average of 2.8 denier. The strength results are shown in Table 1.

Control 2 (C2)

Polypropylene monocomponent spunbond fiber web was produced in accordance with the procedure outlined in Example 2, except the spinning die was replaced with a monocomponent die of the same dimensions and the polymer composition was supplied through the first extruder only. The extruder temperature profile was 340° F., 389° F., 431° F., 430° F. and 431° F. for zones 1–5, respectively. The monocomponent spunbond fibers had an average of 2.1 denier. The strength results are shown in Table 1.

TABLE 1

| | Peak Load (lb) | | Peak Energy (in-lb) | |
|---|---|---|---|---|
| Example | MD | CD | MD | CD |
| Ex1 | 29 | 18 | 30 | 17 |
| C1 | 22 | 14 | 18 | 14 |
| Ex2 | 21 | 16 | 18 | 16 |
| C2 | 17 | 13 | 14 | 17 |

Note:
MD = machine direction
CD = cross machine direction

The results demonstrate that the sheath-core fiber fabrics exhibit sustantially improved strength over the monocomponent fiber fabrics. For example, the peak load of Ex1 is about 30% higher than C1 in both MD and CD, and the peak load of Ex2 is about 23% higher than C2 in both MD and CD. The results clearly show that the single polymer sheath-core fiber fabrics of the present invention have improved physical properties over a monocomponent fiber fabric produced from the same polymeric composition.

Example 3

In order to establish that the polymeric components of the conjugate fibers were not subjected to significantly different processing conditions and were not exposed to substantially different thermal histories, the polymer composition disclosed in Example 1 was extruded through the first and second extruders, in which zones 1–5 of the first extruder were kept at 340° F., 389° F., 430° F., 431° F. and 430° F., and zones 1–3 of the second extruder were kept at 430° F., 380° F. and 431° F., respectively. The resulting extrudates were collected and analyzed for their melt flow rate (MFR) in accordance with the ASTM 1238-65T testing procedure at 230° C. The results are shown in Table 2.

TABLE 2

| Extrudate | MFR (g/10 min) | Standard Deviation |
|---|---|---|
| First Extruder | 70 | 6 |
| Second Extruder | 65 | 7 |

The difference in the MFR values of the two extrudates are within the margin of error of the test, indicating that the MFR value of the two extrudates are not statistically different. Therefore, the improved strength properties of the present sheath-core fiber fabrics are not attributable to the difference in the MFR of the extruded polymer compositions.

The bonded nonwoven fabrics of the present invention that are produced from single polymer conjugate fibers containing sheath and core components of one polymeric composition or substantially identical polymeric compositions provide highly improved strength over monocomponent nonwoven fiber fabrics of the same polymeric composition. In addition, the production of the single polymer conjugate fiber fabric, which is produced with a conventional conjugate fiber web forming process, does not require specialized or complicated manufacturing processes.

What is claimed is:

1. A high strength autogenously bonded nonwoven fabric comprising single polymer conjugate fibers having at least two components compositions, said conjugate fibers having a sheath-core configuration, all of said component compositions consisting essentially of one thermoplastic polymer selected from the group consisting of semicrystalline thermoplastic polymers, crystalline thermoplastic polymers and blends thereof, wherein said component compositions are processed with an identical processing condition or substantially identical processing conditions to form said fibers such that the at least two component compositions have a melt flow rate differences of equal to or less than about 10 g/10 minute.

2. The high strength nonwoven fabric of claim 1 wherein said thermoplastic polymer is selected from the group consisting of polyolefins, polyesters, polyamides, acetals, acrylic polymers, polyvinyl chloride, vinyl acetate-based polymers and blends thereof.

3. The high strength nonwoven fabric of claim 1 wherein said thermoplastic polymer is a polyolefin.

4. The high strength nonwoven fabric of claim 1 wherein said thermoplastic polymer is polypropylene.

5. The high strength nonwoven fabric of claim 1 wherein said conjugate fibers are spunbond fibers.

6. The high strength nonwoven fabric of claim 1 wherein said conjugate fibers are staple fibers.

7. A laminate structure comprising the nonwoven fabric of claim 1.

8. A high strength autogenously bonded nonwoven fabric comprising single polymer conjugate fibers having at least two component compositions, said conjugate fibers having a sheath-core configuration, each of said component compositions consisting essentially of the same thermoplastic polymer selected from the group consisting of semicrystalline thermoplastic polymers, crystalline thermoplastic polymers and blends thereof, and each of said component compositions having been subjected to a process consisting essentially of the same processing conditions to form said conjugate fibers, wherein the processed component compositions forming the conjugate fibers have a melt flow rate difference of equal to or less than about 5 g/10 min, as measured in accordance with the ASTM 1238-65T testing procedure.

9. The high strength nonwoven fabric of claim 8 wherein said thermoplastic polymer is selected from the group consisting of polyolefins, polyesters, polyamides, acetals, acrylic polymers, polyvinyl chloride, viny acetate-based polymers and blend thereof.

10. The high strength nonwoven fabric of claim 8 wherein said conjugate fibers are spunbond fibers.

11. The high strength nonwoven fabric of claim 8 wherein said conjugate fibers are staple fibers.

12. The high strength nonwoven fabric of claim 8 wherein the melt flow rates of said processed component compositions is equal to or less than about 5 g/10 minute.

13. The high strength nonwoven fabric of claim 8 wherein the melt flow rates of said processed component compositions is equal to or less than about 1 g/10 minute.

14. The high strength nonwoven fabric of claim 8 wherein said thermoplastic polymer is a polyolefin.

15. The high strength nonwoven fabric of claim 8 wherein said thermoplastic polymer is polypropylene.

16. The high strength fabric of claim 8 wherein said two component compositions have a melt flow rate difference of equal to or less than about 1 g/10 min.

* * * * *